United States Patent [19]

Hauslaib

[11] Patent Number: 4,671,441

[45] Date of Patent: Jun. 9, 1987

[54] MONITORING PLURAL FEEDING IN PRINTERS

[75] Inventor: Wolfgang Hauslaib, Langenau, Fed. Rep. of Germany

[73] Assignee: Mannesmann AG, Duesseldorf, Fed. Rep. of Germany

[21] Appl. No.: 726,479

[22] Filed: Apr. 24, 1985

[30] Foreign Application Priority Data

Apr. 25, 1984 [DE] Fed. Rep. of Germany ..... 3415741

[51] Int. Cl.[4] ..... B41J 13/26; B41J 11/50; B65H 7/04; B65H 7/08

[52] U.S. Cl. ..... 226/110; 226/11; 271/111; 271/261; 271/265; 400/605; 400/708

[58] Field of Search ..... 226/10, 11, 24, 45, 226/110; 400/605, 708, 708.1, 670.1; 200/61.13-61.17, 61.42; 271/111, 261, 265

[56] References Cited

U.S. PATENT DOCUMENTS

| | | | |
|---|---|---|---|
| 2,523,184 | 9/1950 | Beall | 200/61.14 |
| 3,202,779 | 8/1965 | Call | 200/61.42 |
| 3,716,178 | 2/1973 | Shimmin | 226/11 |
| 4,111,565 | 9/1978 | Jagger | 400/708 |

FOREIGN PATENT DOCUMENTS 2525263 10/1981 Fed. Rep. of Germany .

OTHER PUBLICATIONS

W. M. Davis, Trailing Edge Sensor, IBM Technical Disclosure Bulletin, vol. 7, No. 5, Oct. 1964.

*Primary Examiner*—John M. Jillions
*Assistant Examiner*—Lynn M. Sohacki
*Attorney, Agent, or Firm*—Ralf H. Siegemund

[57] ABSTRACT

A printer having a plurality of differently located feed paths for print material including in each instance a feed channel, has also separately positioned feeler and scanning levers projecting into the respective feed path and channel, in the case of absence of print material in the respective feed path and channel, but the respective lever is pushed out of the channel and feed path in the case of presence of the respective print material; the scanning levers and feelers are linked by a slotted cam plus pin linkage and one of the levers carries a single switch actuating element such as a projector; electric contact making and breaking switching means with three point biased and clamped tongues are actuated by said actuating element to provide a first switching state when print material and sheet stock is in one of said feed paths and channels, independently from the particular channel and feed path involved and providing a second switch state when none of said feed paths and channels includes or contains sheet stock and print material to be printed on.

9 Claims, 1 Drawing Figure

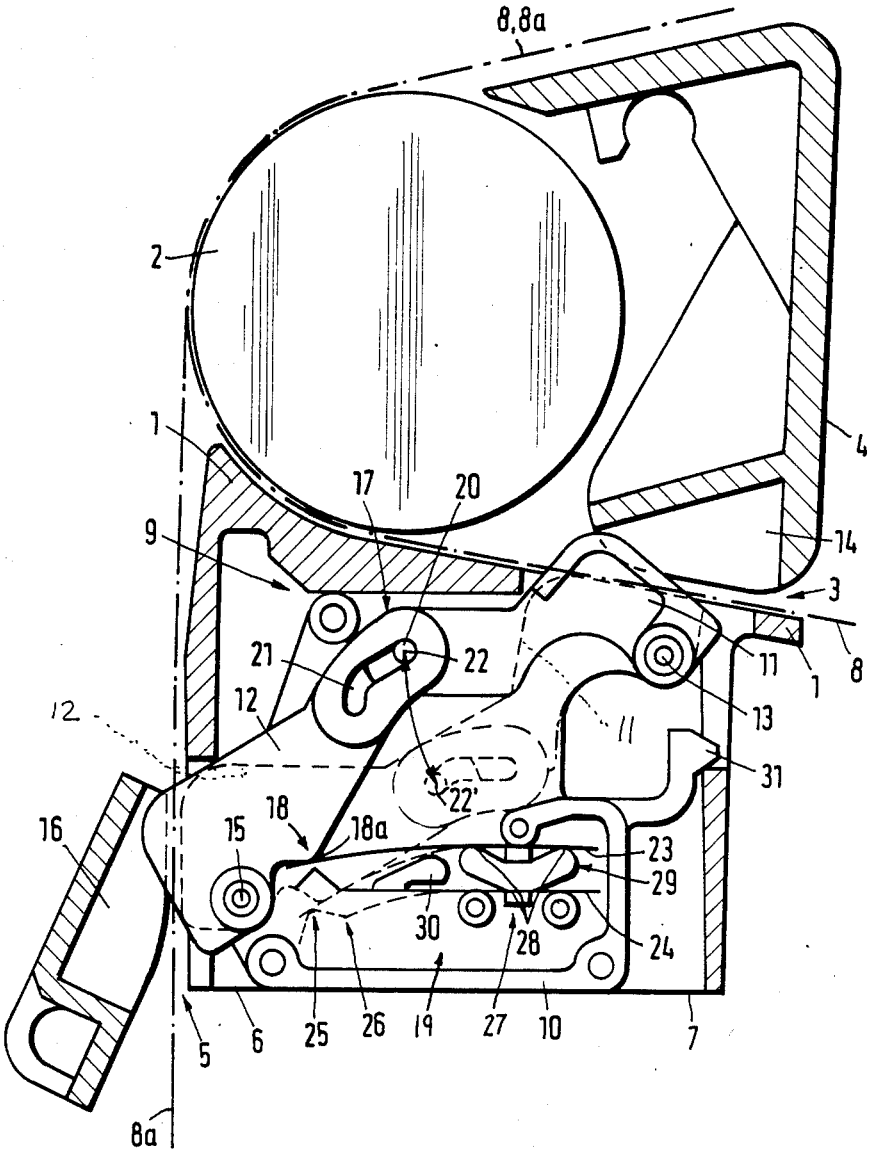
8,8a
2
1
4
17
20
9
14
3
8
21
22
11
1
12
12
13
11
31
22'
16
15
18
18a
23
29
30
28
24
5
6
25
26
19
27
10
7
8a

MONITORING PLURAL FEEDING IN PRINTERS

BACKGROUND OF THF INVENTION

The present invention relates to a printer particularly a matrix printer of the variety in which different print media are to be fed to the printer through separate guide and feed channels arranged for example on different sides of the printer casing.

Print medium feed devices include frequently switching arrangements and feeling or scanning levers which can be pivoted right into the path of the respective print medium such as sheets a web of paper so as to monitor the leading edge of such sheet and to monitor more generally the presence or absence of sheet stock in the respective feed channel. In the case of a printer having multiple feed path care should be taken so that only one feed path actually provides for feeding at a time.

The aforementioned switching device for detecting and monitoring absence or presence of sheet stock in a feed path are usually provided for purposes of furnishing an indication whether or not the printer is actually in an operating state in which printing can occur on a print medium; whether the medium has sufficiently advanced into the printer; whether the medium has or has not yet run out. In case there is no such print medium in the printer, obviously printing cannot take place which is possible if the sheet stock is exhausted, a roll of a paper has run out, or torn off, or bunched up elsewhere etc. The sheet stock is provided with edge perforations for purposes of transport.

German printed patent application No. 2,525,263 suggests a transport device for sheet stock wherein several webs are juxtaposed and are more or less transported in parallel but independently from each other through the printer and separate switches are provided in order to monitor these different sheets or webs separately. This kind of an arrangement is on one hand dictated by the requirement of having several sheets transported in parallel through the same printer. A rather complicated transfer arrangement is necessary here. In accordance with a different mode of construction of a matrix printer, several feed paths for print stock are arranged on different sides of the print housing but require a specified feature with regard to the arrangement of the paper and sensing device.

DESCRIPTION OF THE INVENTION

It is an object of the present invention to provide improvements for a printer in order to accomodate plural feed paths for print media being arranged on different sides of the casing of the printer whereby particularly the improvement is related to switching structure which responds to presence and absence, beginning and end of any of the print stock sheets.

In accordance with the preferred embodiment of the present invention it is suggested to provide a single switching device for monitoring absence or presence of sheet stock for all feed paths into a matrix printer whereby, however, this single switching device is constructed to have a separate feeler or scanning lever for each feed path which feelers or scanning levers are linked mechanically while one of the levers or feelers is provided with an actuator to obtain the single switching action. Thus the invention provides for monitoring plural sheet stock feedpath with a single switching device being constructed to respond separately and individually to absence or presence of sheet stock in the respective feedpath. Hence the user does no longer have to consider which of the feed paths is actually used.

It is therefore a principle of the invention to provide separate scanning and feeling of the absence or presence of print stock in any of the feed channels and to mechanically combine the feeling and scanning operation such that an absence from all of the feed path channels establishes a single first switching state while presence of print stock in any one of the feed paths and channels establishes a second switching state whereby it is no longer necessary to provide a separate indication for each of the channels. This concept is based on the assumption that the feed operation as it occurs and the selection of the particular feed path by the operator is under his immediate control and visual inspection. The switching operations are primarily provided for timing and phasing internal printer operations and these are in fact independent from the particular location of any entrance and any selection of feed path and channels.

In furtherance of the invention it is suggested to link the feeling and scanning levers for the several feed paths and channels through a slotted cam configuration which is quite economical. The association should be such that one of the particular feelers and scanning levers is provided with a projection which is being moved whenever any of the feed paths contains paper or other sheet stock, and that particular projection is used physically to actuate the single switch. The scanning levers should be pivotably mounted in the casing there being guides provided for limiting the stroke of the levers; the frame itself can serve here as displacement limiting device for the scanning levers.

In furtherance of the invention the switch actuated by the linked levers is preferably constructed from elongated contact tongues which are spring biased and actuated by the aforementioned projection. These elongated contact members have a rather flat spring characteristics which is preferred for this kind of operation. The contact paths are controlled in that the tongues are clamped at the location opposite the respective contact making zone or area whereby preferably a three point support is established. Moreover, the clamping of the contact tongues at the one end should be combined with the establishing of a tension bias in at least one of the contact tongues in order to exercise some control over the displacement path length of the contact making point or points. The particular tension bias is again established through a three point spacer; in addition, a stop being stationary in the casing may further limit and/or define one end of the displacement path for the contact tongue so that this limit in conjunction with the three point bias establishes very accurately the displacement path length as between open and closed contact states.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE illustrates a cross section through a printer improved in accordance with the preferred embodiment of the present invention for practicing the best mode thereon. The FIGURE shows particularly a printer with printing platen, frame, sheet stock, paper feed paths and the novel switching device.

Proceeding now to the detailed description of the drawing, the FIGURE shows a printer, frame, housing or casing 1 in which a printing platen drum or roller 2 is rotatably mounted. The frame 1 is integral with a lower housing portion 7. The frame or housing 1 is provided with a first paper feed path and channel 3 at the rear side 4, and a paper feed path and channel 5 at the underside 6 of the casing or bonding portion 7. Sheet stock such as paper 8 and 8*a* is respectively transported into and through feed path 3 or 5, as the case may be.

The two feed path and channels 3 and 5 are monitored as to presence or absence of sheet stock by means of a common switching device 9 in accordance with the preferred embodiment of the present invention. The switching device is described under the premises that the solid drawn line of the switching device represents a switch position which can be described as "paper end" or "no paper in feed path" while the dotted line position of the switch are representative of the state "paper is present".

The switching device 9 is illustrated in the FIGURE with a coverplate removed permitting view into the interior of the switch housing 10. The switch housing 10 is provided with a projection 31 for positioning within the printer frame 1. The feed path 3 is associated with a feeler or scanning lever 11 while the feed path 5 is associated with a feeler or scanning lever 12. The lever 11 is rotatably mounted in the casing 10 for rotation about an axis 13. Moreover the lever 11 is guided by means of guide structure 14 arranged to both sides of the lever 11 and arranged on or being part of the frame. Analogously, the lever 12 is mounted for rotation in the casing for rotation about axis 15. Also there are two guides 16 arranged and the lever is arranged in between them. The lever 12 is also shown in a "no paper" position (down line); one can see the retracted position in dotted lines.

The two levers 11 and 12 are interconnected by means of an articulated (length compensating pivotal) linkage 17. On the other hand the lever 12 which is an arbitrary selection is provided in addition with an actuator element 18 which includes a projection 18*a* and is provided for engagement of a switch 19 in order to turn the switch 19 on or off.

The linkage 17 is constructed to include a template or slotted cam element 21 proper having a slot 20, the lever 12 is physically directly connected to cam element 21 and a pin 22 is held in slot 20 and is connected to the lever 11.

The switch 19 includes oblong, spring biased, contact tongues 23 and 24. The contact position 25 is illustrated in dash dot position in the range of the contact area 26. The contact tongues 23 and 24 are rather long and, therefore, exhibit a comparatively flat spring characteristic. The contact tongues 23 and 24 are particularly clamped at an end 27 being situated opposite the contact area 26. This clamping of the contact tongues 23 and 24 at the end 27 causes a bias particularly through a three point mount 28 and is established by means of a three point spacer 29. This spacer 29 thus provides a dual function: the three point support clamps the contact tongues 23 and 24 at one end and, additionally tension biases them to obtain a particular resilient force tending to move the tongue towards a contact open position. A stop 30 is provided limiting the contact path length right in the area of contact making 26 involving particularly the displacement path of the contact tongue 23.

The device in accordance with the invention operates as follows: assuming that paper 8*a* is fed into the feed channel 5 on the underside 6 of the printer, this sheet stock will run specifically through the guide member in the printer frame 1 (lower housing part 7). The feeler or scanning level 12 is normally provided to project into that feeder path 5 but the leading edge of the sheet stock 8*a* will push the lever 12 from the position shown in drawn lines into the position drawn in dotted lines. This pivot motion occurs about the axis 15. As a consequence of this pivot motion of lever 12 the projection 18*a* is forced upon the contact tongue 23 and therefore the contact between elements 23 and 24 is closed. It can thus be seen that the switch 19 to which the contacts 23 and 24 pertain is of the type in which contact making or contact closing occurs to indicate "presence of paper" while an open contact state is indicative of "paper end" or "jam", or "paper down", or generally "paper absence". Specifically the open contact state is attained when the rear or trailing edge of sheet stock 8*a* passes through the feed channel 5 causing the lever 12 to drop back into the channel 5, the motion being induced by the spring force and resiliency of the biased contact tongue 23. The contacts 23 and 24 of course open accordingly.

Alternatively when paper 8 is fed from the rear side 4 of the printer housing and into the duct or feed channel 3 this sheet of paper 8 will run between the guide structure 14 and the frame 1. Normally the lever 11 is, as stated, in the fully drawn position, while the leading edge of sheet stock 8 will push the lever 11 from the fully drawn position into the position indicated in dotted lines. As a consequence the pin 22 causes through the cam and template member 21, to move the feeler 12 into the position 22' such that both levers 11 and 12 undergo the same motion. Thus, again the contacts 23 and 24 are closed and also by operation of the projection 18*a*.

The contact tongues 23 and 24 are configured for purposes of obtaining the switching operations in a particularly advantageous manner whereby attention has been given to the structural configuration of these individual parts. It has to be observed that the contacts 23 and 24 have to make contact before the levers 11 and 12 have left the guides 14 and 16 completely. This then requires a certain excess stroke length which has to be sufficient such that the levers 11 and 12 can be moved from the position shown in solid lines to the position shown in dotted lines without impediment and without any substantial increase in the return force.

The contact tongues 23 and 24 are relatively long and have, therefore, rather flat spring characteristics. This feature renders maintaining contact spacing tolerances rather difficult. Even small deviations from a straight contour and shape of the tongues 23 and 24 do affect the contact spacing significantly. This specific structural problem is solved through the constant position of the contact tongues 23 and 24. The tongues 23 and 24 are inserted under tension biased conditions. The tensioning bias is limited through the three point positioning 28,29 which takes care of any predetermined tolerance requirements of the tongues 23 and 24. The tension bias causes the tongue 24 to be bent in direction towards the tongue 23. This so called bending, however, is limited by the stop 30 in a very accurate manner which now determines the effective contact spacing when open. In other words the spacing between the contacts 23 and 24 is indeed constant even if the tension in the tongues differs to some extent. This means that during assembly of the parts it is not necessary to provide particular adjusting operations as they are to be effective in each individual case.

The invention is not limited to the embodiments described above but all changes and modifications thereof, not constituting departures from the spirit and scope of the invention are intended to be included.

I claim:

1. In a printer having a plurality of differently located feed paths for print material including in each instance a feed channel, the improvement comprising:

separately positioned feeler and scaning levers projecting respectively into the feed path and the channel, in the case of absence of print material in the respective feed path and channel, but being respectively individually and independently pushed out of the channel and feed path in the case of presence of the respective print material in the channel or the feed path;

coupling means for linking all of said scanning levers and feelers;

a single switch actuating element connected to one of said levers; and electric contact making and breaking switching means actuating by said actuating element to provide a first switching state when print material and sheet stock is in one or said feed paths and channels, regardless which one of the particular channel and of feed path is involved, and providing a second switch state when none of said feed paths and channels includes or contains sheet stock and print material to be printed on.

2. The improvement as in claim 1 wherein said means for linking includes a slotted cam and a pin sliding in a slot of the cam.

3. The improvement as in claim 1 wherein one of said levers carries a slotted cam, the other of said levers carries a pin riding in the slot of the cam to thereby link the two levers together for the transmission of pivot motion of one to the particular actuator element, said actuating element being a projection.

4. The improvement as in claim 1 wherein said switching means includes spring biased elongated contact tongues actuated by said actuating element.

5. The improvement as in claim 4 wherein at least one of the contact tongues is clamped at the end opposite to the location of contact making.

6. The improvement as in claim 5 wherein at least one of the contact tongues is resiliently biased.

7. The improvement as in claim 5 wherein clamping of the respecting tongues is configured as a threepoint support.

8. The improvement as in claim 6 wherein said bias is provided by a three point support spacer.

9. The improvement as in claim 5 including a stop for maintaining a particular spacing between the contacts when in a contact open position.

* * * * *